United States Patent [19]

Curry

[11] 4,392,364

[45] Jul. 12, 1983

[54] FLAT BED KNITTING MACHINE

[76] Inventor: Roger F. N. Curry, 46, Cleveland Sq., London, W.2, England

[21] Appl. No.: 239,603

[22] Filed: Mar. 2, 1981

[30] Foreign Application Priority Data

Mar. 13, 1980 [GB] United Kingdom ..... 8008567

[51] Int. Cl.[3] ..... D04B 7/00

[52] U.S. Cl. ..... 66/60 H; 66/78

[58] Field of Search ..... 66/60 H, 60 R, 114, 66/115, 78

[56] References Cited

U.S. PATENT DOCUMENTS

| | | | |
|---|---|---|---|
| 2,748,581 | 6/1956 | Luchsinger | 66/115 |
| 2,759,343 | 8/1956 | Schurich | 66/60 H |
| 2,816,425 | 12/1957 | Kaufmann | 66/115 X |
| 2,963,888 | 12/1960 | Suzuki et al. | 66/60 X |
| 3,063,270 | 9/1958 | Schurich | 66/60 H |
| 3,320,018 | 6/1967 | Kuhnert | 66/64 |
| 3,448,593 | 6/1969 | Groom | 66/115 |
| 3,823,580 | 7/1974 | Caridi | 66/60 |

*Primary Examiner*—Ronald Feldbaum

*Attorney, Agent, or Firm*—Fulwider, Patton, Rieber, Lee & Utecht

[57] ABSTRACT

A flat bed knitting machine comprising a flat elongate bed on which is retained a plurality of parallel, latchable, needles equally spaced along the length of the bed and each movable relative to the bed in a direction lengthwise of the needles and transverse of the bed length, a carriage slidably mounted on the bed for movement transversely of the needles, and a needle-engaging cam plate releasably located in a recess in an upper surface of the carriage and retained in the recess, the carriage having a handle gripped by the user of the machine to transverse the carriage back and forth along the length of the bed.

8 Claims, 8 Drawing Figures

FLAT BED KNITTING MACHINE

This invention relates to flat bed knitting machines, and it is an aim of the invention to provide a flat bed knitting machine which is easy to use and uncomplicated in construction to enable low cost manufacture.

According to the invention there is provided a flat bed knitting machine comprising a flat elongate bed on which is retained a plurality of parallel, latchable, needles equally spaced along the length of the bed and each movable relative to the bed in a direction lengthwise of the needles and transverse of the bed length, a carriage slidably mounted on the bed for movement transversely of the needles, and a needle-engaging cam plate releasably located in a recess in an upper surface of the carriage and retained in the recess, the carriage having a handle gripped by the user of the machine to traverse the carriage back and forth along the length of the bed.

According to a feature of the invention, there is provided a plurality of cam plates each locatable one at a time in the recess and each having a different cam shape to form one of a plurality of different stitch sizes.

According to another feature of the invention, the bed is formed from a plurality of side-by-side interconnected identical module units.

According to a further feature of the invention, there is provided a shaped rod member extending from the carriage, and operable in use to restrain the upper portion of the knitted fabric from any significant movement while the needles are pushed therethrough by the action of the cam plate.

Figure 1:
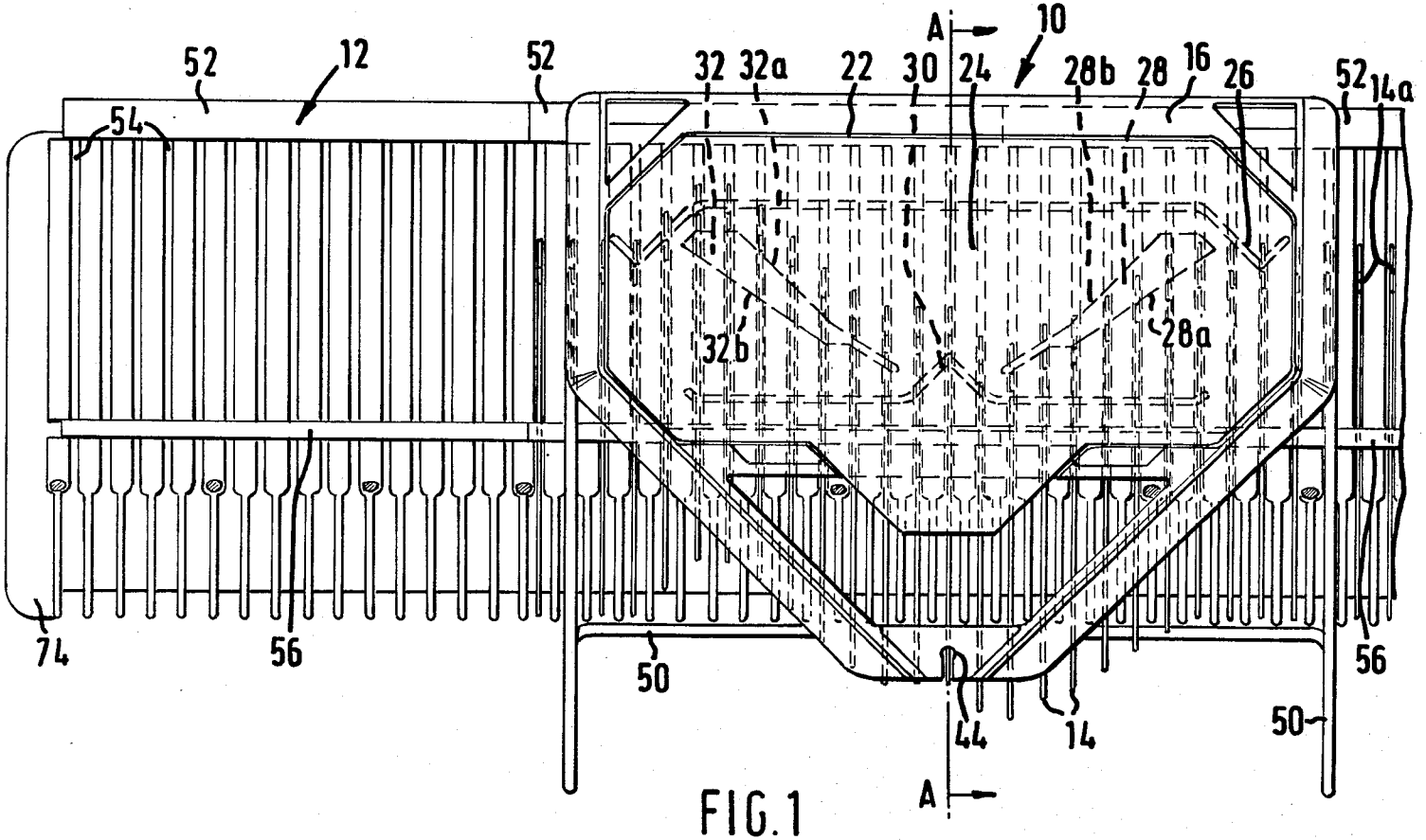
Figure 2:
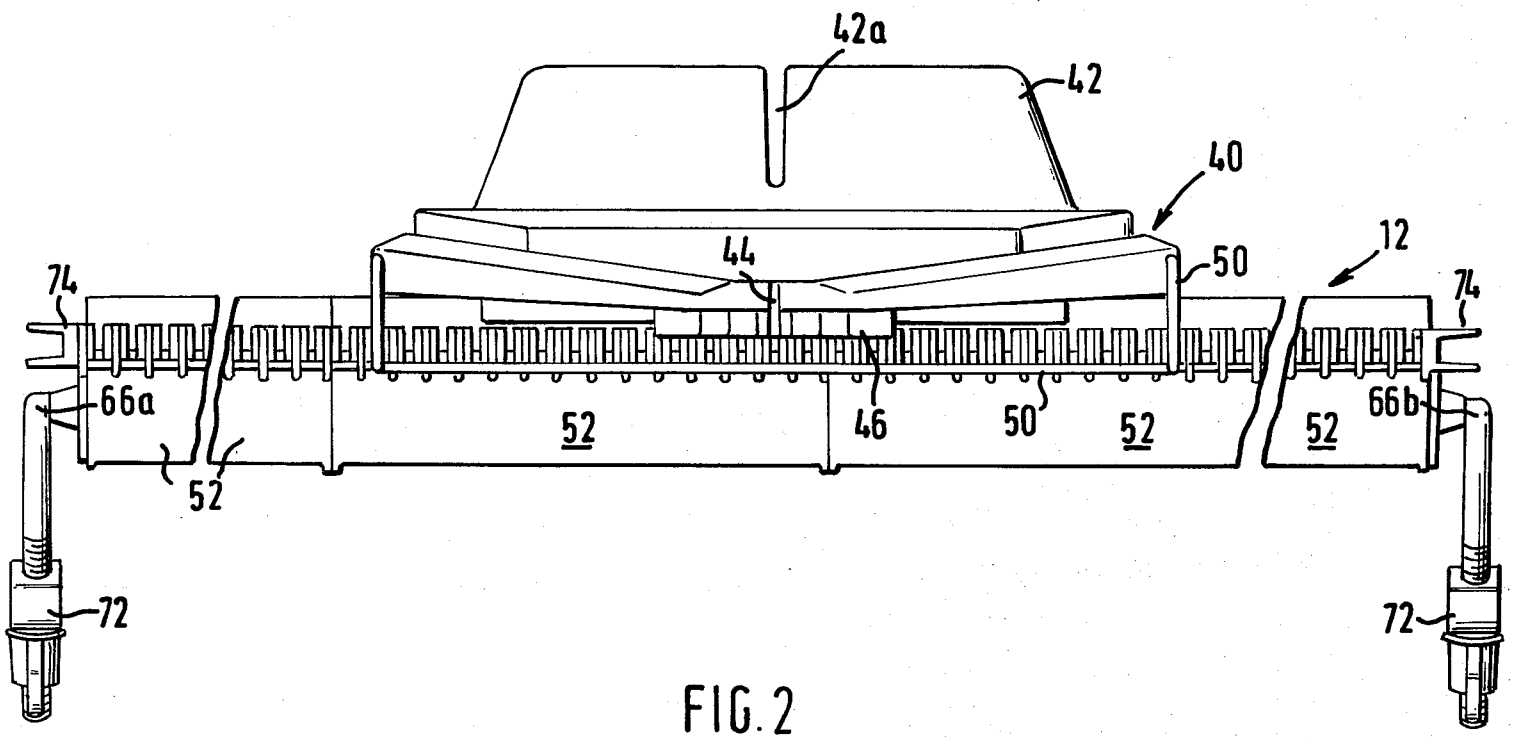
Figure 3:
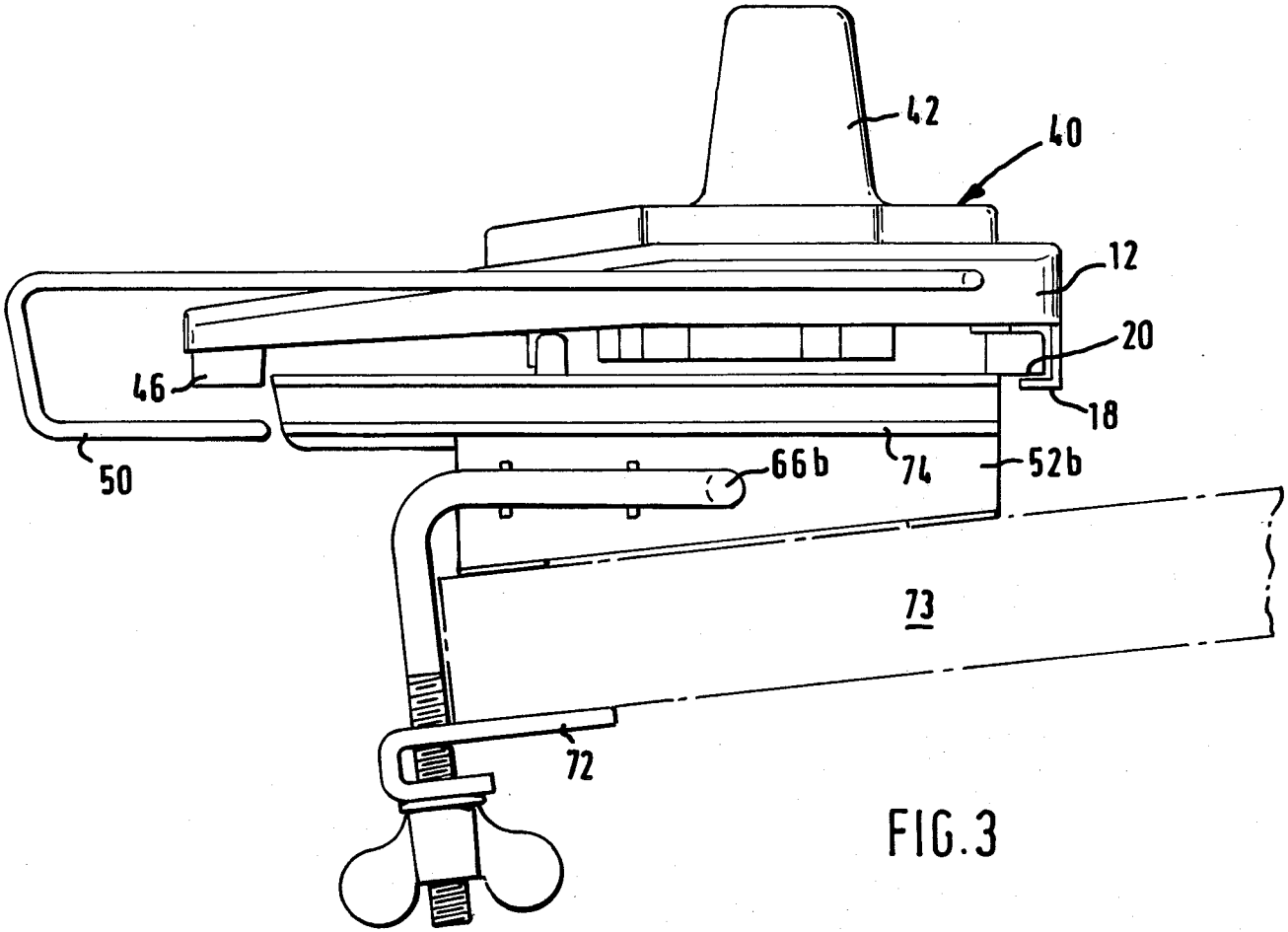
Figure 4:
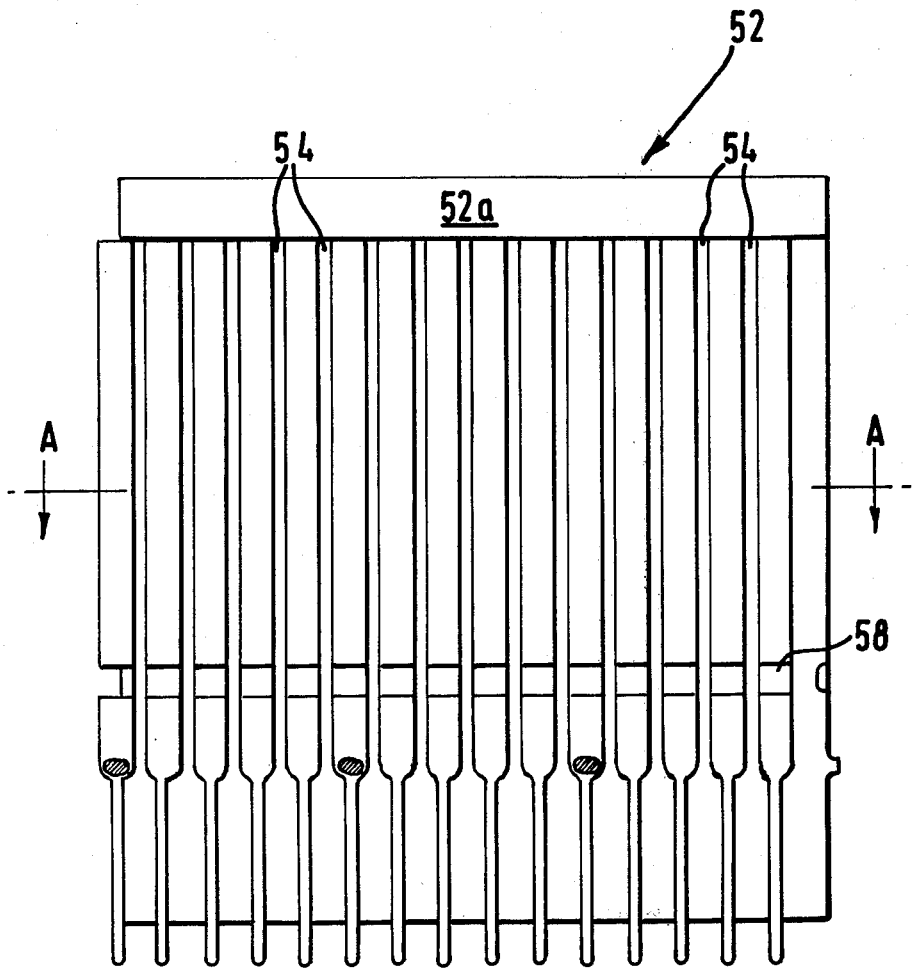
Figure 5:
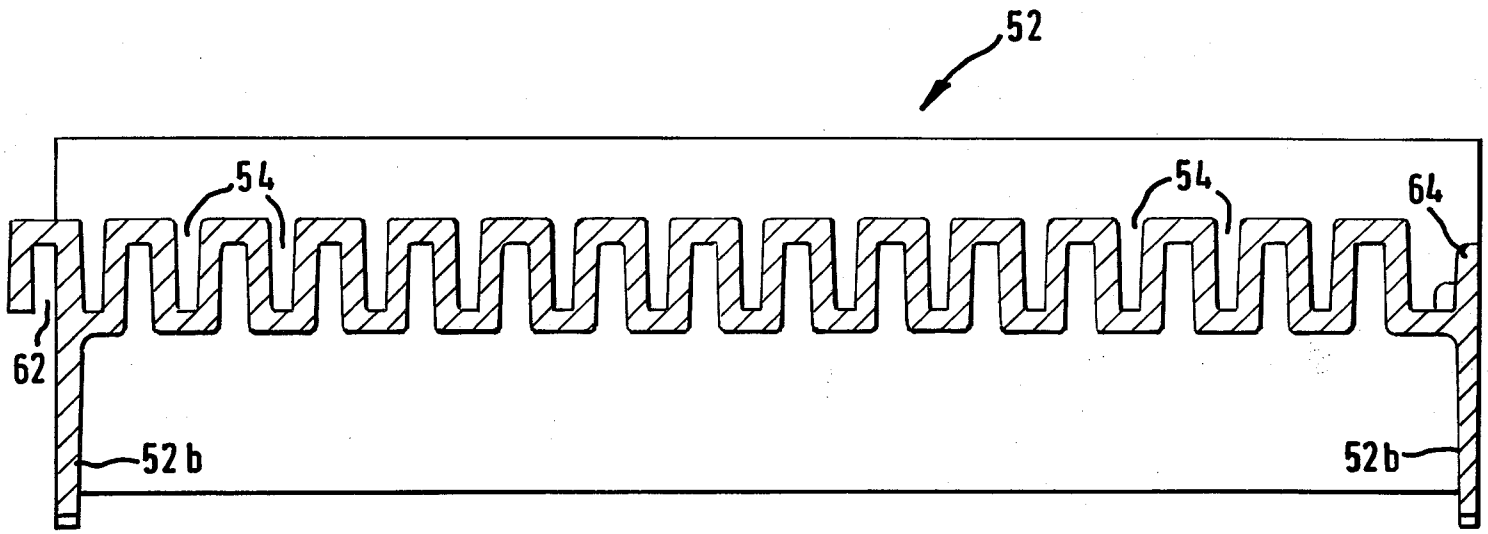
Figure 6:
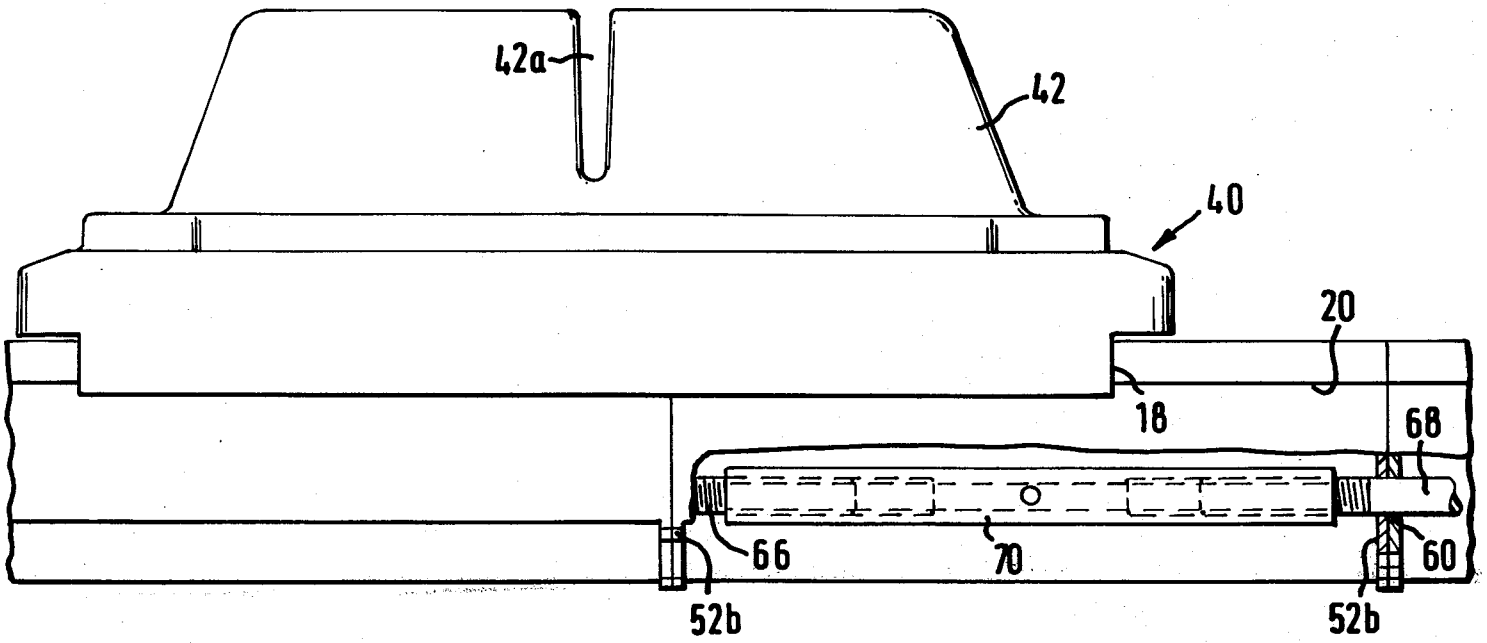
Figure 7:
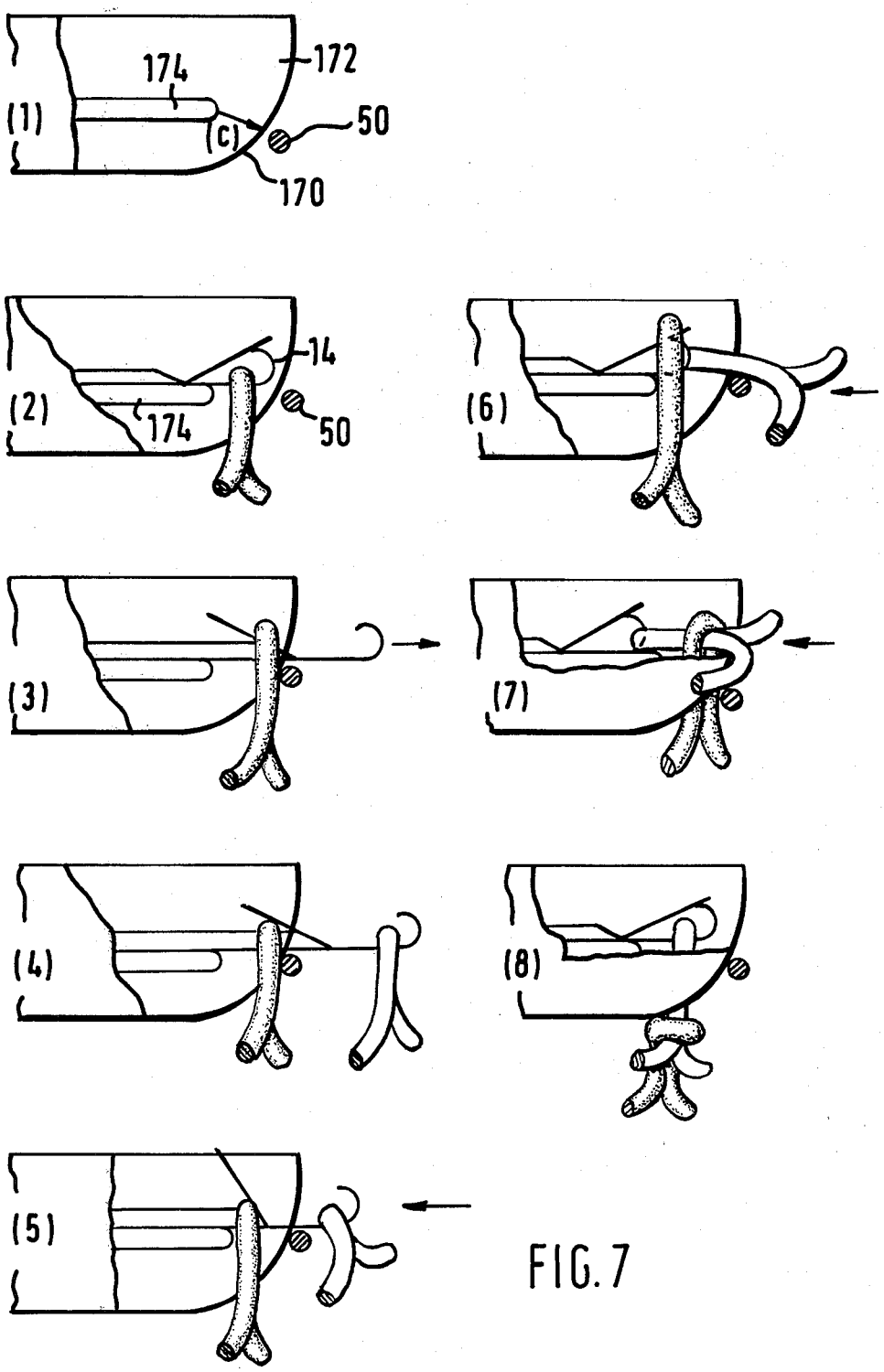
Figure 8:
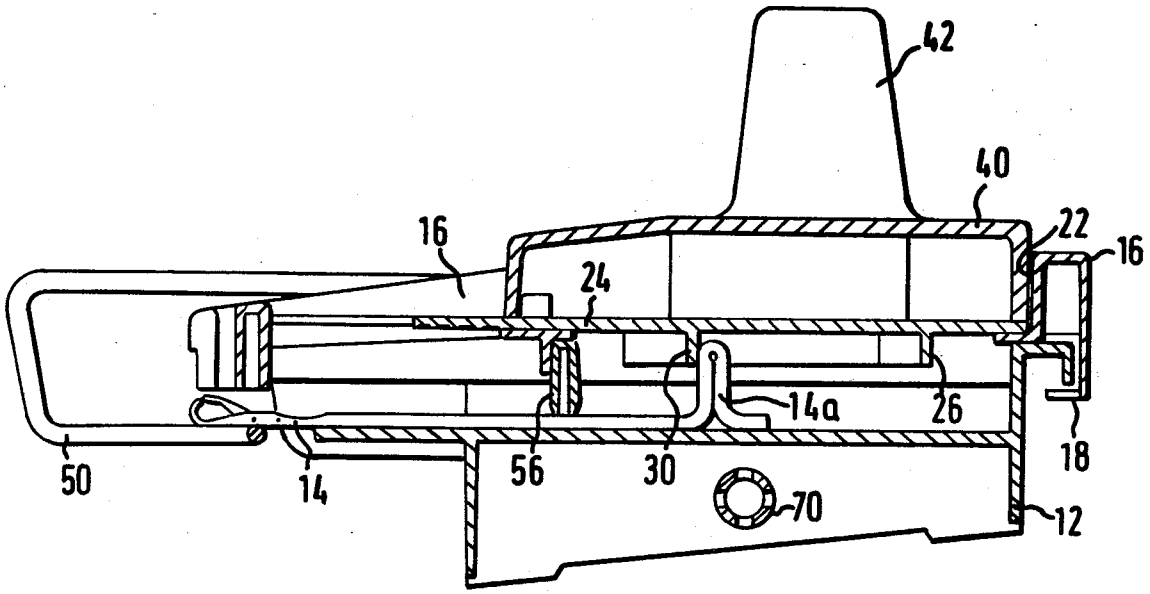

An embodiment of the invention will now be described by way of example only, with reference to the accompanying drawings, in which:

FIG. 1 is a part plan view of a flat bed knitting machine according to the invention, with the handle removed, FIG. 2 is a front view of the machine of FIG. 1, FIG. 3 is a side view of the machine of FIG. 1, FIG. 4 is a plan view of a module unit forming part of the flat bed of the machine of FIG. 1, FIG. 5 is a section on the line A—A of FIG. 4, on an enlarged scale, FIG. 6 is a part view of the machine, FIG. 7 shows diagramatically the sequential steps in the formation of a stitch, and FIG. 8 is a section on the line A—A of FIG. 1.

Referring to the drawings, the flat bed knitting machine 10 includes a flat elongate bed 12, on which is retained a plurality of parallel latchable needles 14 equally spaced along the length of the bed and each movable relative to the bed in a direction lengthwise of the needles and transverse of the bed length. Slidably mounted on the bed for movement transversely of the needles is a carriage 16 having its rear at a downwardly depending 'L' shaped tab 18 which engages a downwardly facing back edge 20 of the bed, thereby to assist in retaining and guiding the carriage over the bed. The carriage body when viewed in plan is of open construction and includes a recess 22 in its upper surface in which is releasably located a needle engaging cam plate 24.

The upper surface of the cam plate is generally flat, and from the lower surface projects a series of cams 26, 28, 30 and 32 which, during each passage of the carriage over the bed, engages knob portions 14*a* of the needles to project the needles forward through the knitted fabric and then retract them back again to form a stitch. Assuming the carriage is moving to the right as viewed in FIG. 1, portions 14*a* of the needles, which have been aligned by cam 26 on exit from the cam plate on a previous pass, are engaged by the lower surface 28*a* of cam 28 to project the needles forward through the knitting fabric. After leaving cam 28, portions 14*a* are sequentially engaged by cam 30 to position portions 14*a* into the path of cam 32, by the upper surface 32*a* of cam 32 to retract the needles and then by cam 26 to realign the needles in readiness for the next pass of the carriage in an opposite direction. During the return pass, portions 14*a* are first engaged by the lower surface 32*b* of cam 32 to project the needles forward again and then portions 14*a* are engaged by the upper surface 28*b* to retract the needles.

Located on top of the cam plate is a member 40 which retains the cam plate in the recess and which carries a handle 42 gripped during use of the machine by the user to traverse the carriage back and forth along the length of the bed. The handle includes a yarn guiding slot 42*a* which guides the yarn from a nearby yarn holder (not shown) to a yarn guide 44 carried at the front of the carriage.

Adjacent guide 44 is a shaped flat member 46 formed integrally with the carriage and operable in use to hold the yarn down on the needle hooks and also to prevent the needle latches from closing after the needles have been pushed through the knitted fabric so they can receive yarn from the yarn guide 44 to form the new stitch.

Extending from the carriage and running parallel therewith is a shaped wire rod 50 the purpose of which is to restrain the upper portion of the knitted fabric from any significant movement while the needles are pushed forward therethrough by the action of the cam plate.

Conveniently, the bed 12 is formed from a plurality of side-by-side interconnected, identical, module units 52. Each unit (see FIGS. 4 and 5) had a body 52*a* which is serpentine in cross-section to provide a plurality of side-by-side needle recesses 54, the needles being retained in the recesses by a removable bar 56 located in a transverse slot 58. Extending downwardly from the body are two spaced legs 52*b* each provided with an aligned hole 60. As viewed in FIG. 5, the left hand side of the unit 52 is shaped as a downwardly opening channel 62 and the right hand side as an upwardly extending ridge 64. When assembling the units to form the flat bed of the knitting machine, ridge 64 of each unit is clipped into the channel of an adjacent unit until the required length of bed is built up. To secure the units as a coherent whole, (see FIG. 6) two elongate rods 66, 68 are pushed from opposite ends of the bed through holes 60 and are fixed together by a central, threaded sleeve 70, the inner ends of the rods 66, 68 being threaded in opposite directions so that rotation of the sleeve in one direction by a suitable tool will thread the sleeve onto the rods and hence pull the rods inwardly to secure the units. Outer ends 66*a*, 68*a* of the rods 66, 68 are provided with clamps 72 to enable the machine bed to be clamped to a table support 73. The two outermost module units are not provided with needles to provide a run-out for the carriage, but have end caps 74 clipped thereto. Because the bed is of modular form the standard length of bed can be easily extended by adding further module units; to achieve this a longer threaded sleeve 79 would be required to effectively extend the overall length of the clamping rods 66, 68.

Conveniently, the handle carrying member 40 and the cam plate 24 are made from a transparent material so that the operator can see at a glance when a jam or blockage has occurred beneath the cam plate. This feature also makes the machine particularly suited for demonstrating to students how the knitting operation is carried out.

To enable different sized stitches to be knitted, a plurality of cam plates would be provided each carrying one of a plurality of different cam profiles, whereby to vary the stroke of the needles relative to the bed. The forces experienced by the cam plate when in motion are determined by a number of factors. One factor is the profile of the cams; for any one knitting machine there is a particular cam profile which will minimize the forces on the cam plate for any given pitch of the latched needles, type of yarn being used and stitch size being knitted.

Referring to FIG. 7, which illustrates in sequence the steps in forming a stitch, it should be mentioned that the profile of the front edge 170 of fingers 172 separating the needles, and its distance C from the front edge 174 of the flat bed must be accurately determined if the stitches are to be formed properly; these dimensions also determine stitch size. The position of the shaped wire rod 50 relative to the needles and profile 170 should also be accurately determined.

On exit from the cam plate, cam 26 pushes the needles forward. This action causes the needles to be lined up ready for the next pass, and also enables the stitches to finish forming by allowing them to drop round and down the profile 170, see step (8) of FIG. 7.

With known domestic knitting machines, variation in the stroke of the needles to provide different stitch sizes is provided by adjusting the position of the cams relative to the carriage body. However, since the physical shape of the cams remains unaltered, it is not possible to accommodate the effects of different types of yarn or stitch sizes on the cam plate and therefore the forces thereon are not minimized. In contrast, the present machine is provided with a series of different cam plates, the cam of each cam plate can be individually designed and located to suit a particular yarn, size and stitch, and pitch of the needles, thereby ensuring minimal forces acting on the cam plate during use.

Other advantages of the above described flat bed knitting machine are:

1. No tensioning of the yarn is necessary in its feed to the needles, and therefore tensioning arms and needle damper bars as employed in conventional knitting machines can be omitted.

2. The use of a flat member 46 and shaped rod 50 acting to restrain the upper portion of the knitted fabric eliminates the need for expensive bushes and wheels as used in conventional knitting machines.

It will be apparent that the above described flat bed knitting machine fully meets the stated aim of the present invention.

I claim:

1. A flat bed knitting machine comprising a flat elongate bed on which is retained a plurality of parallel, latchable, needles equally spaced along the length of the bed and each movable relative to the bed in a direction lengthwise of the needles and transverse of the bed length, a carriage slidably mounted on the bed for movement transversely of the needles, and a needle-engaging cam plate releasably located in a recess in an upper surface of the carriage and retained in the recess, the carriage having a handle gripped by the user of the machine to transverse the carriage back and forth along the length of the bed.

2. The machine of claim 1, wherein the handle is provided by a suitably shaped member positioned on top of the cam plate to retain it in said recess.

3. The machine of claim 2, wherein the handle member and the cam plate are of transparent material.

4. The machine of claim 1, wherein the handle is provided with a slot to guide the yarn from a yarn holder to a yarn guide located on the carriage.

5. The machine of claim 1, including a shaped rod member extending from and parallel to the carriage and operable in use to restrain the upper portion of the knitted fabric from any significant movement while the needles are pushed therethrough by the action of the cam plate.

6. The machine of claim 1, wherein the bed is formed from a plurality of side-by-side interconnected identical module units.

7. The machine of claim 6, wherein each unit is of serpentine cross-section to provide a plurality of needle recesses, one side of the unit being shaped as a channel and the other side as a ridge, the ridge of one unit being clipped into the channel of another to build up the bed, each unit having a transverse slot to receive a needle retaining bar.

8. The machine of claim 6, including one or more rods passing through aligned holes in the units to permit the units to be secured together as a coherent whole.

* * * * *